United States Patent [19]

Minakuchi

[11] Patent Number: 4,675,593

[45] Date of Patent: Jun. 23, 1987

[54] VOLTAGE POWER SOURCE CIRCUIT WITH CONSTANT VOLTAGE OUTPUT

[75] Inventor: Yusuke Minakuchi, Nara, Japan

[73] Assignee: Sharp Kabushiki Kaisha, Osaka, Japan

[21] Appl. No.: 912,167

[22] Filed: Sep. 26, 1986

Related U.S. Application Data

[63] Continuation of Ser. No. 662,788, Oct. 19, 1984, abandoned.

[30] Foreign Application Priority Data

Oct. 25, 1983 [JP] Japan ..... 58-200260

[51] Int. Cl.[4] ..... G05F 3/08; G05F 1/58

[52] U.S. Cl. ..... 323/314; 307/296 R

[58] Field of Search ..... 323/313, 314, 315, 316; 307/296 R, 297

[56] References Cited

U.S. PATENT DOCUMENTS 4,087,758 5/1978 Hareyama ..... 323/314

4,362,985 12/1982 Tsuchiya ..... 323/314

4,422,033 12/1983 Minner et al. ..... 323/314

4,506,208 3/1985 Nagano ..... 323/314

*Primary Examiner*—Patrick R. Salce

*Assistant Examiner*—D. L. Rebsch

*Attorney, Agent, or Firm*—Birch, Stewart, Kolasch & Birch

[57] ABSTRACT

A constant power voltage circuit includes a first transistor for generating a collector current, a second transistor for generating a collector current, a third transistor, the collector of which is connected to the collector of the first transistor, a fourth transistor, the collector of which is connected to the collector of the second transistor, an emitter-grounded amplifier circuit including a fifth transistor for providing a feedback loop, with a fifth transistor, the collector which is connected to a constant current circuit and the base current of the third and the fourth transistors, being outputted from the constant current circuit upon the application of a power source.

3 Claims, 1 Drawing Figure

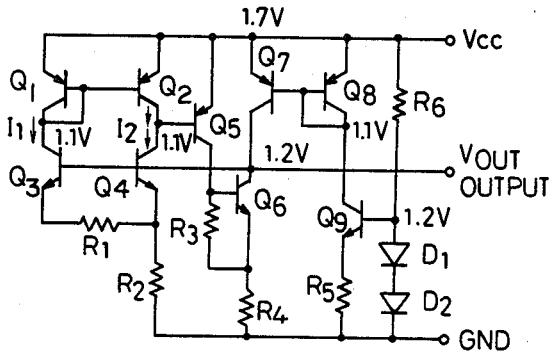
1.7V
Vcc
Q1
Q2
Q7
Q8
R6
I1
1.1V
I2
1.1V
Q5
1.1V
1.2V
VOUT
OUTPUT
Q3
Q4
Q6
Q9
1.2V
R1
R3
D1
R2
R5
D2
R4
GND

VOLTAGE POWER SOURCE CIRCUIT WITH CONSTANT VOLTAGE OUTPUT

This application is a continuation of application Ser. No. 662,788 filed on Oct. 19, 1984 and now abandoned.

BACKGROUND OF THE INVENTION

The present invention relates to a constant power source voltage circuit and, more particularly, to circuit for a constant voltage power source of a band-gap type which operates with a low voltage.

In the conventional constant voltage power source circuit, the lowest driving voltage cannot be decreased to less than about 2.0 volts, and the output voltage from the constant voltage power source circuit may vary in accordance with variations of a voltage inputted from a power source. Further, the conventional constant power voltage circuit requires its own driving circuit for operation.

SUMMARY OF THE INVENTION

Accordingly, it is an object of the present invention to provide an improved constant voltage power source circuit which operates with a low power voltage, and makes an output voltage constant against variations of the inputted power voltage.

It is another object of the present invention to provide an improved constant voltage power source circuit which is operated without needing provide an additional driving It is still another object of the present invention to provide a constant voltage power source circuit of a band-gap type.

It is a further object of the present invention to provide an improved constant voltage power source circuit for outputting a constant voltage by decreasing the variation of an output voltage due to the variation of an inputted power voltage.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

According to an embodiment of the present invention, a constant voltage power source circuit comprises a first transistor for generating a collector current, a second transistor for generating the collector current, a third transistor the collector of which is connected to the collector of the first transistor, a fourth transistor, the collector of which is connected to the collector of the second transistor, an emitter-grounded amplifier circuit including a fifth transistor for providing a feedback loop, with the collector of the fifth transistor connected to a constant current circuit, and the base current of the third and the fourth transistors being outputted from the constant current circuit upon the application of a power source and normal condition thereof. A difference between the base-emitter voltages of the third and the fourth transistors relies on a band-gap voltage difference. The feedback loop loops the two collector connections and the base of the third and the fourth transistors.

BRIEF DESCRIPTION OF THE INVENTION

The present invention will be better understood from the detailed description given hereinbelow and the accompanying drawing which by way of illustration only, and thus is not limitative of the present invention and wherein:

The single FIGURE shows a circuit diagram of a constant power voltage circuit according to an embodiment of the present invention.

DETAILED DESCRIPTION OF THE INVENTION

Referring to the single FIGURE, there is shown a circuit diagram of a constant power voltage circuit according to an embodiment of the present invention including transistors Q1–Q9, resistances R1–R6, and diodes D1 and D2.

The bases of the transistors Q1 and Q2 are connected to each other, and the bases of the transistors Q3 and Q4 are connected to each other. The collectors of the transistors Q1 and Q3 are connected to each other, and the collectors of the transistors Q2 and Q4 are connected to each other. The base of the transistor Q1 is connected to the collector of the transistor Q1 to provide a diode connection.

If the areas of the base, the collector, and the emitter of the transistors Q1 and Q2 are identical or in the same pattern, current $I_1$ equals current $I_2$ because a base-emitter voltage of the transistor Q1 is equal to a base-emitter voltage of the transistor Q2, so that the same collector current can flow at the transistors Q3 and Q4. In this case, if the area of the emitter of the transistor Q3 is ten times that of the emitter of the transistor Q4, a current density in the transistor Q4 produced by the base-emitter junction of the transistor Q3 is 1/10 that of the current density in the transistor Q3, so that the base-emitter voltage of the transistor Q2 is decreased by the following band-gap voltage difference, which is less than that of the transistor Q4 in a room temperature of an absolute temperature about 300 degrees K.

$$\Delta V_{BE}=26 \ln 10=60(\text{mV})$$

where 26=KT/q: Absolute Temperature T=300 degrees K., K=Boltzman's Constant, and q=Electron Charge.

The collector current of the transistor Q3 is given as follows because the collector current of the transistor Q3 approximately equals the emitter current of the transistor Q3.

$$I_1=0.06/R1$$

Accordingly, a current $I=2I_1=0.12/R1$ can flow through the resistance R2 because the current $I_1$ equals the current $I_2$. Therefore, the voltage between the both ends of the resistance R2 is given as follows.

$$V=0.12(R2/R1)$$

Where the ratio of R2 to R1 is 5 (R2/R1=5), the voltage V=0.6 Volts.

The resistance R1 is connected between the emitters of the transistors Q3 and Q4 and the resistance R2 is connected between the emitter of the transistor Q4 (the connection between the resistance R1 and the transistor Q4) and ground (the ground level).

On the other hand, the base-emitter voltage of the transistor Q4 is about 0.6 Volts in accordance with a current level of an IC (Integrated Circuit) which is normally used. Accordingly, an output voltage Vout of the constant power voltage circuit becomes a constant voltage of about 1.2 Volts which is the sum of the voltage across the resistance R2 and the base-emitter voltage of the transistor Q4.

In the above circuit, to output the constant voltage Vout it is necessary that the circuit be arranged so that current $I_1$ equals current $I_2$ to output the constant voltage Vout. The transistors Q5–Q9 are provided for this purpose. A feedback loop is formed by the transistors Q5 and Q6.

The collectors of the transistors Q2 and Q4 are connected to on another and also to the base of the transistor Q5, and the collector of the transistor Q5 is connected to the base of the transistor Q6. Further, the collector of the transistor Q6 is connected to the bases of the transistors Q3 and Q4. The conventional constant current circuit is provided with the transistors Q7, Q8, and Q9, the diodes D1 and D2, and the resistances R5 and R6.

When the current $I_1$ is applied which equals the value 0.06/R1 as calculated above, the currents $I_1$ and $I_2$, which are equal to each other, flow to output the constant voltage Vout. If the current $I_1$ is less than the value 0.06/R1, the collector current of the transistor Q3 becomes greater than the collector current of the transistor Q4 because the voltage across of the resistance R1 becomes less than about 60 mVolts.

When the voltage across the resistance R1 is less than 60 mVolts, a current which is greater than the current flowing through the transistor Q4 flows through the collector of the transistor Q2, the excess being the base current of Q5, so that the base potential of the transistor Q5 is made high, and the collector current of the transistor Q5 is decreased. Therefore, the base potential of the transistor Q6 is lowered and the collector current of the transistor Q6 is decreased. Because a constant current flows out from the transistor Q7, the collector potential of the transistor Q6, which is also, the base potential of each of the transistors Q3 and Q4 is increased and the current $I_1$ is increased.

When the current $I_1$ is greater than the value 0.06/R1, the collector current of the transistor Q3 is less than the collector current of the transistor Q4, so that the collector current of the transistor Q4 becomes more than the collector current of the transistor Q2, and that the base potential of the transistor Q5 is decreased and the collector current of the transistor Q5 is increased, and that the base potential of the transistor Q6 becomes high and the collector current of the transistor Q6 is increased. Therefore, the base potential of each of the transistors Q3 and Q4 is decreased and the current $I_1$ is decreased.

As described above, the current $I_1$ is constantly set at the value 0.06/R1 and the constant voltage of about 1.2 Volts is introduced from the constant power voltage circuit of the present invention as the output voltage Vout. The output voltage Vout is unrelated to the inputted power voltage Vcc because the output voltage Vout is calculated without consideration of the value of the power voltage Vcc.

In order to equalize the collector currents of the transistors Q3 and Q4 as much as possible, the transistors Q5 and Q1 are connected in parallel, and further, the transistors Q5 and Q2 are connected in parallel. Preferably, the resistance R3, connected between the base of transistor Q6, which is also the collector of transistor Q5, and the emitter of the transistor Q6, may be selected so that the collector current of the transistor Q5 may be twice the collector current of the transistor Q3 or Q4.

The constant power voltage circuit of the figure can be driven with a low power voltage Vcc of about 1.7 Volts in case where the voltage between the base and the emitter of the transistor is set at about 0.6 Volts and the output voltage Vout is set at about 1.2 Volts. The transistor can be driven in a linear operation only when the current from the base to the collector rarely flows and is negligible. For example, in the transistor included in an IC (Integrated Circuit) which is generally used, the transistor is driven in the linear operation only when the base potential exceeds the collector potential by less than 0.2 Volts.

When the base potential of the transistor is not more than about 0.2 Volts larger than that of the collector of the transistor, the lowest power voltage Vcc can be applied for driving the transistor in the linear operation. But, in order to securely drive the transistor in the linear operation, it is necessary to set the potential difference between the base and the collector of the transistor at about 0.1 volts. The operation of the constant power voltage circuit of the FIGURE will be described when about 1.7 Volts of the power source is outputted.

In the case where the base-emitter voltage of the transistor is set at about 0.6 Volts and the output voltage Vout is set about 1.2 Volts, and further, where the base potential of the transistor is set to about 0.1 Volts higher than that of the collector of the transistor, the base potential of each of the transistors Q3 and Q4 is about 1.2 Volts when the output voltage Vout of about 1.2 Volts is outputted from the constant power voltage circuit, so that the collector potential of each of the transistor Q3 and Q4 becomes about 1.1 Volts. The power voltage Vcc for driving the transistor in the liner operation is about 1.7 Volts which is an addition of the base-emitter voltage (about 0.6 Volts) of the transistor Q1 and Q2 and the collector potential (about 1.1 Volts) of the transistor Q3 or Q4.

On the other hand, in the constant current circuit, the anode potential of the diode D1 or the base potential of the transistor Q9 is about 1.2 Volts, and the collector potential of the transistor Q9 is about 1.1 Volts, so that the power voltage Vcc for driving the transistor in the linear operation is about 1.7 Volts which is an addition of the base-emitter voltage (about 0.6 Volts) of the transistor Q8 and the collector potential (about 1.1 Volts) of the transistor Q9.

In the present invention, an emitter-grounded amplifier circuit comprising the transistors Q5 and Q6 is provided for increasing a gain of the circuit of the FIGURE. The collector-emitter voltage of each of the transistors Q1 and Q2 equals the base-emitter voltage of each of the transistors Q1 and Q2, respectively, and are not effected with the power voltage Vcc because the transistor Q5 is connected.

The resistance R4 is connected to the emitter of the transistor Q6 so as to control the gain of the circuit of the FIGURE to prevent its oscillation.

In the circuit of the FIGURE, the output voltage Vout is rarely varied by the variation of the output current because the output current is applied by the collector of the transistor Q7. The constant current circuit comprising the transistors Q7–Q9, the resistances R5 and R6, and diodes D1 and D2 serves as a driving circuit for driving the constant power voltage circuit of the FIGURE. The transistor Q6 is cut off until the output voltage Vout is finally increased by a predetermined voltage level after the power is switched on, in other words, the power voltage Vcc is inputted, so that the base current of the transistor Q3 and Q4 can flow by supplying the collector current of the transistor Q7. Even after the output voltage Vout is at the predetermined voltage level, the base current of the transistors Q3 and Q4 can flow by supplying the collector current of the transistor Q7. Therefore, it is unnecessary that the transistor Q7 be separated from the transistors Q3 and Q4 after driving.

The constant power voltage circuit according to an embodiment of the present invention may comprise a bipolar IC, or the like.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A constant power voltage circuit comprising:

a first transistor for developing a collector current;

a second transistor for developing a second collector current;

a third transistor the collector of which is connected to the collector of the first transistor;

a fourth transistor the collector of which is connected to the collector of the second transistor where the emitter area of said third transistor is larger than the emitter area of said fourth transistor and the collector current of said third transistor approximately equals the collector current of the fourth transistor;

an emitter-grounded amplifier circuit including a fifth transistor for providing a feedback loop along with a sixth transistor, the collector of which is connected to a constant current circuit and to the bases of the third and fourth transistor; and the base current of the third and fourth transistors resulting from an output of the constant current circuit upon the application of a power source and normal condition thereof.

2. The constant power voltage circuit of claim 1, wherein a difference between the base-emitter voltages of the third and the fourth transistors is dependent on a band-gap voltage difference.

3. The constant power voltage circuit of claim 1, wherein the feedback loop feeds back from the connection of the collectors of said second and fourth transistors to the bases of the third and the fourth transistors.

* * * * *